US012440071B2

(12) United States Patent
Tramontina et al.

(10) Patent No.: US 12,440,071 B2
(45) Date of Patent: Oct. 14, 2025

(54) FLUID DISPENSER WITH METERED DOSE CONTROL FEATURES

(71) Applicant: Kimberly-Clark Worldwide, Inc., Neenah, WI (US)

(72) Inventors: Paul F. Tramontina, Harleysville, PA (US); Anita Neidert, Roswell, GA (US); Charles A. Osborne, Jr., Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/579,547

(22) PCT Filed: Aug. 12, 2021

(86) PCT No.: PCT/US2021/045742

§ 371 (c)(1),
(2) Date: Jan. 16, 2024

(87) PCT Pub. No.: WO2023/018414

PCT Pub. Date: Feb. 16, 2023

(65) Prior Publication Data

US 2024/0315495 A1 Sep. 26, 2024

(51) Int. Cl.
*A47K 5/12* (2006.01)

(52) U.S. Cl.
CPC ..... *A47K 5/1217* (2013.01); *A47K 5/1202* (2013.01); *A47K 2005/1218* (2013.01)

(58) Field of Classification Search
CPC ..... A47K 5/1202; A47K 5/1217; F04B 2203/0201–0202; F04B 2203/0401–0402; F04B 23/02–028
See application file for complete search history.

(56) References Cited

U.S. PATENT DOCUMENTS 3,953,777 A * 4/1976 McKee ..... E21B 47/009 361/87
4,286,925 A * 9/1981 Standish ..... F04B 49/10 417/18

(Continued)

FOREIGN PATENT DOCUMENTS

JP H0451923 A 2/1992

OTHER PUBLICATIONS

PCT Search Report Corresponding to Application No. PCT/US2021/045742 on Nov. 30, 2021.

(Continued)

*Primary Examiner* — Paul R Durand
*Assistant Examiner* — Randall A Gruby
(74) *Attorney, Agent, or Firm* — Dority & Manning, P.A.

(57) ABSTRACT

A dispenser system and method for dispensing metered doses of a foam or liquid is disclosed. The dispensing system can include a pumping device for pumping metered doses of a liquid from a liquid reservoir out through a nozzle. The pumping device can include an electronically commutated motor that provides greater accuracy and uniformity in dispensing metered doses. During operation of the pumping device, one or more electrical parameters can be monitored and based on the electrical parameters, the system can make adjustments in dispensing metered doses. In one aspect, the electrical parameter can be monitored to determine whether the liquid reservoir contains a low level of liquid.

15 Claims, 5 Drawing Sheets

(56) References Cited

U.S. PATENT DOCUMENTS 4,361,176 A 11/1982 West
4,921,150 A * 5/1990 Lagergren ..... G01F 13/006 222/639
4,967,935 A * 11/1990 Celest ..... A47K 5/1217 222/642
5,836,482 A 11/1998 Ophardt et al.
6,209,752 B1 * 4/2001 Mitchell ..... A47K 5/1215 222/325
6,414,455 B1 * 7/2002 Watson ..... H02P 27/06 417/18
6,467,651 B1 * 10/2002 Muderlak ..... B05B 12/02 222/63
6,651,851 B2 * 11/2003 Muderlak ..... B05B 11/1008 222/333
6,929,150 B2 8/2005 Muderlak et al.
7,527,178 B2 * 5/2009 Lewis ..... A47K 5/1217 222/105
7,540,397 B2 6/2009 Muderlak et al.
8,020,727 B2 9/2011 Herman et al.
8,109,411 B2 2/2012 Yang et al.
8,371,474 B2 * 2/2013 Tramontina ..... B05B 11/1001 222/642
8,622,713 B2 * 1/2014 Hampton ..... F04B 49/065 417/63
8,651,329 B2 2/2014 Reynolds et al.
9,648,991 B2 * 5/2017 Tramontina ..... A47K 5/1217
9,830,764 B1 * 11/2017 Murphy ..... G07F 9/023
10,022,741 B2 * 7/2018 Fuller ..... B01F 33/841
10,024,325 B2 * 7/2018 Phillips ..... F04D 15/0245
10,403,079 B2 9/2019 Wegelin et al.
10,624,503 B2 * 4/2020 Tramontina ..... A47K 5/1217
11,710,086 B2 * 7/2023 Ghazi ..... G06Q 10/06 700/236
2005/0171634 A1 * 8/2005 York ..... G07F 11/68 700/231
2005/0218161 A1 * 10/2005 Muderlak ..... A61L 9/12 222/333
2009/0266842 A1 * 10/2009 Snodgrass ..... A47K 5/1217 222/326
2009/0308887 A1 * 12/2009 Woo ..... A47K 5/1215 222/113
2013/0240554 A1 * 9/2013 Strahlin ..... A47K 10/32 221/6
2013/0292411 A1 * 11/2013 Bem ..... A47K 5/1217 417/44.1
2014/0367401 A1 * 12/2014 Stralin ..... A47K 10/38 221/6
2015/0199865 A1 7/2015 Wegelin
2015/0228181 A1 * 8/2015 Himmelmann ..... G06Q 10/063118 340/573.1
2015/0335208 A1 * 11/2015 Ciavarella ..... A47K 5/1211 222/145.5
2020/0003217 A1 * 1/2020 Wilds ..... F04D 15/0016
2022/0018055 A1 * 1/2022 Hibdon ..... D06F 39/085
2024/0225375 A1 * 7/2024 Tramontina ..... A47K 5/1217

OTHER PUBLICATIONS

Das et al., Development of a Novel Design and Subsequent Fabrication of an Automated Touchless Hand Sanitizer Dispenser to Reduce the Spread of Contagious Diseases, Healthcare, vol. 9, Issue 4, 2021, 17 pages, https://doi.org/10.3390/healthcare9040445.

* cited by examiner

FLUID DISPENSER WITH METERED DOSE CONTROL FEATURES

RELATED APPLICATIONS

The present application is the national stage entry of International Patent Application No. PCT/US2021/045742 having a filing date of Aug. 12, 2021, which is incorporated herein in its entirety by reference thereto.

BACKGROUND

Various types of dispensers are known for dispensing liquid soap from a container as a metered dose of liquid or foam. These dispensers are typically used in public restroom facilities, hospitals and other healthcare facilities, food service establishments, and so forth. A number of the known dispensers utilize a housing that mounts onto a counter, a wall, or other support surface, with the housing containing a replaceable liquid soap reservoir or container, such as a collapsible bag, bottle, or other type of disposable container. A pump mechanism is configured with the housing and mates with a dispensing neck of the soap container once the container has been properly seated in the housing.

Various different pump mechanisms have been used in the past. In some applications, the pump mechanism is designed to dispense a metered dose of soap from the liquid soap reservoir. Problems have been experienced, however, in designing a pump mechanism that is capable of accurately and uniformly dispensing metered doses of soap. Variability in the amount of soap dispensed can lead to various problems.

For example, in certain dispensing systems, the system includes a counter that counts the number of metered doses that are dispensed. This information is then used to calculate and determine when the liquid soap dispenser is empty. In certain dispensing systems, for instance, refills are completed by removing an empty reservoir and replacing the empty reservoir with a replacement reservoir which is filled with the liquid product. Due to the variability of the pump mechanism, however, maintenance personnel may fail to timely replace a liquid soap reservoir that is empty or will replace a liquid soap reservoir before it is empty, which can result in significant product waste.

In view of the above, a need currently exists for a fluid dispenser with improved controls for dispensing metered doses of a liquid in which the amount that is dispensed does not vary over time. A need also exists for an improved liquid dispenser capable of more accurately determining when a liquid reservoir contains low levels of liquid product.

SUMMARY

In general, the present disclosure is directed to a dispenser for liquids and foams, particularly a soap composition, that includes a pumping device with improved controls for dispensing metered doses of a liquid. The present disclosure is also directed to a dispenser for dispensing metered doses of a foam or liquid, such as a soap composition, wherein the dispenser includes improved controls for determining when a liquid reservoir contained in the dispenser is in an empty condition or a near empty condition.

For example, in one embodiment, the present disclosure is directed to a dispenser for dispensing metered doses of a foam or liquid from a reservoir. The dispenser includes a nozzle that is in fluid communication with a liquid reservoir. A pumping device is included for pumping metered doses of a liquid from the liquid reservoir and out through the nozzle. A sensor senses at least one electrical parameter of the pumping device during pumping of metered doses. The dispenser further includes a processor in communication with the sensor for receiving information regarding the at least one electrical parameter. If the electrical parameter varies by greater than a preset amount between metered doses of a liquid, the processor is configured to create a signal indicating that the liquid reservoir contains a low level of liquid.

In one embodiment, the pumping device includes a brushless motor and the electrical parameter sensed by the sensor is the draw current of the motor. When the current decreases by greater than the preset amount, the processor creates the signal indicating that the liquid reservoir contains a low level of liquid. In one embodiment, the electrical parameter sensed during dispensing a metered dose is compared to an average value of the electrical parameter over a plurality of previous metered doses to determine if there is a variance greater than the preset amount. In addition, the electrical parameter can be sensed multiple times during a single metered dose in order to determine an average that is then used to determine if the electrical parameter has varied by greater than the preset amount.

In one embodiment, the preset amount can be a percent difference between a current metered dose and past metered doses. For example, in one aspect, the processor can be configured to generate the signal indicating that the liquid reservoir contains a low level of liquid when the preset amount is a difference in the electrical parameter in an amount greater than about 3%, such as in an amount greater than about 3.5%, such as in an amount greater than about 3.8%. When measuring the draw current, for instance, the preset amount can be a percent reduction in the current.

The signal that is created by the processor can vary depending upon the particular application. For example, in one embodiment, the signal can cause a light to illuminate that indicates a low liquid level in the reservoir. Alternatively, the signal generated by the processor can be transmitted to an operation control center. The signal, for instance, can be transmitted wirelessly to a cloud-based operations control center.

In one aspect, the dispenser can further include an actuator that, once actuated, causes the pumping device to pump a metered dose of liquid from the liquid reservoir and out through the nozzle. The actuator, for instance, can be a hand sensor. The actuator, for instance, can emit an IR beam that can detect a hand, which causes the pumping device to activate.

The processor that receives information from the sensor can be any suitable circuitry, electronic device, or the like. The processor, for instance, can be a programmable device. In one aspect, the processor can comprise one or more microprocessors.

The present disclosure is also directed to a dispenser with improved controls for dispensing a metered dose of foam or liquid from a reservoir. The dispenser includes a liquid reservoir in fluid communication with a nozzle. A pumping device is included for pumping metered doses of a liquid from the liquid reservoir and out through the nozzle. In accordance with the present disclosure, the pumping device can comprise a brushless motor. The dispenser can further include an actuator that, when actuated, causes the pumping device to pump a metered dose of liquid through the nozzle. The brushless motor, for instance, can be an electronically commutated motor controlled so as to dispense the same volume of liquid after each metered dose. In one aspect, for instance, the motor can include a rotor comprising one or more magnets and a stator comprising one or more coils. The dispenser can include a sensor that senses at least one electric parameter of the motor. The electric parameter, for instance, can be current draw, torque, rotational velocity, voltage, frequency variations, pulse with modulations, or combinations thereof. A processor can be in communication with the sensor for receiving information regarding the at least one electrical parameter. Based on information received from the sensor, the processor can control the motor in a way for dispensing uniform amounts of a liquid or foam. As described above, the processor can also be configured to determine a low level of liquid condition in the liquid reservoir based on monitoring the at least one electrical parameter.

The dispenser of the present disclosure can comprise any suitable dispenser for dispensing a liquid or foam. In one aspect, the dispenser can include a fixture assembly that is configured to be mounted to an adjacent surface, such as a counter. The fixture assembly can include a dispensing head that contains the nozzle. The dispenser can further include a liquid dispensing tube in communication with the nozzle and the liquid reservoir. The liquid dispensing tube, for instance, can include an opening positioned adjacent to the bottom of the liquid reservoir for dispensing controlled amounts of liquid from the liquid reservoir when the pumping device is actuated.

The present disclosure is further directed to a method for dispensing a liquid or foam from a dispenser. The method includes periodically operating a pumping device for pumping metered doses of a liquid from a liquid reservoir and out through a dispensing nozzle. During periodic operation of the pumping device, at least one electrical parameter of the pumping device is monitored, such as draw current. The method can further include creating a signal indicating that the liquid reservoir contains a low level of liquid when the monitored electrical parameter varies by greater than a preset amount.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
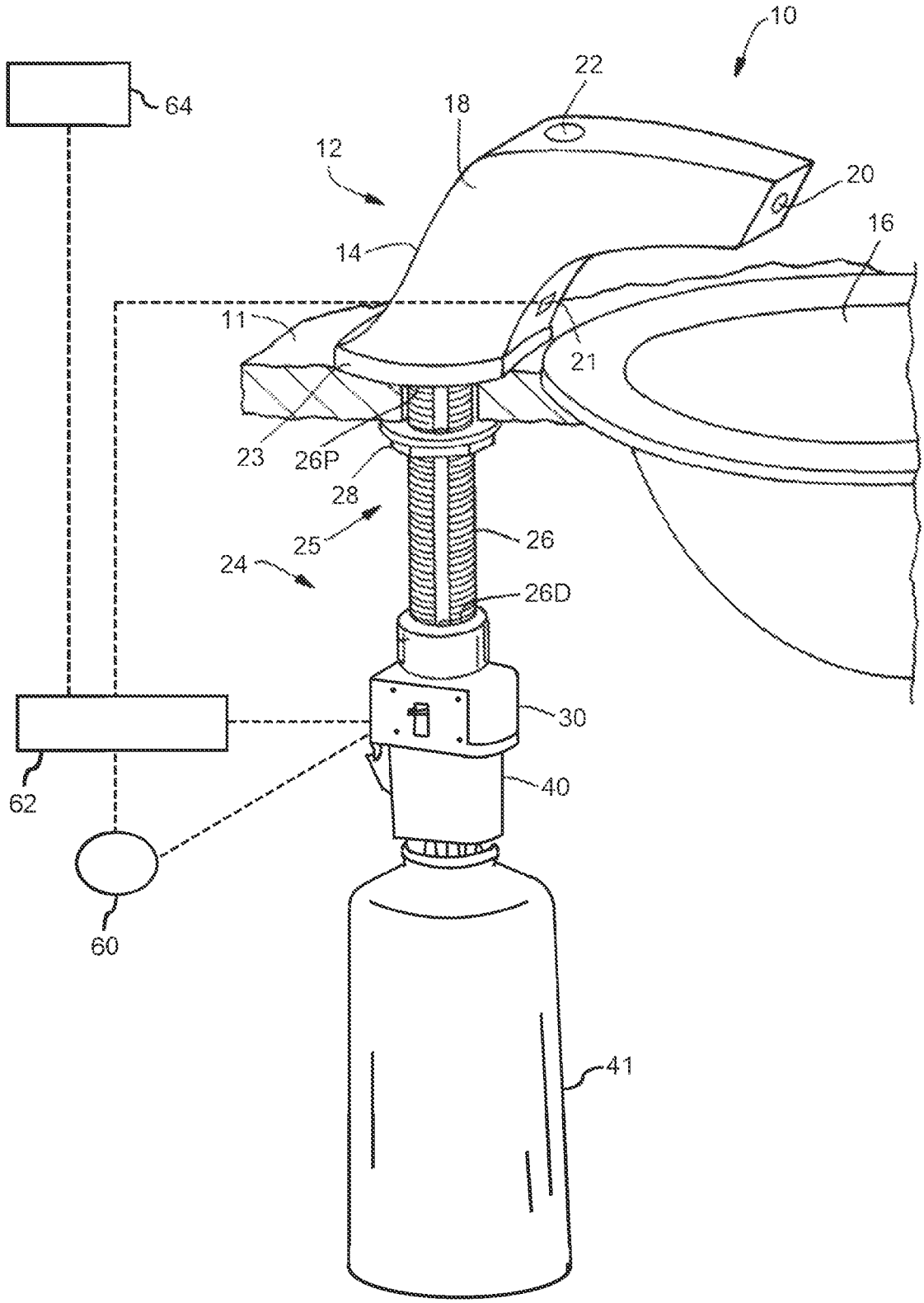
FIG. 1 illustrates a counter-mounted viscous liquid dispenser according to example embodiments of the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a dispenser for containing a liquid and dispensing a liquid or foam. Although any viscous material can be dispensed from the dispenser, the dispenser is particularly well suited to dispensing a soap composition. The soap can be dispensed as a liquid or can be mixed with air and dispensed as a foam. In addition to soap, however, the dispenser can be used in numerous and diverse applications, such as for dispensing edible products such as condiments, industrial products such as oils, and personal compositions such as lotions and creams.

In the past, various dispenser systems have been developed to help maintenance staff understand when it is timely to refill a product dispenser in a serviced facility, such as a restroom. For example, one such system utilizes a dispense count system that is capable of monitoring each dispense count to alert maintenance personnel when a low-product level is realized. Such systems rely on a counter device that counts each time the dispenser dispenses a metered dose of the liquid. In the past, however, dispensers displayed a relatively large variation in the metered dose or shot size that is dispensed. Consequently, creating a low soap alert based on counting metered doses can be highly inaccurate. If the dosage amount is larger than expected, the soap dispenser can remain in an empty state for a prolonged period of time. If the dosage amount is less than expected, on the other hand, a low soap alert may be triggered when the dispenser still contains significant amounts of soap.

In this regard, the present disclosure is directed to a fluid dispenser system capable of dispensing controlled amounts of a liquid or foam with increased accuracy, uniformity, and precision. In addition, instead of simply counting metered doses to determine liquid levels in the reservoir, the system of the present disclosure can include a sensor that senses at least one electrical parameter of a pumping device used to dispense the metered doses. The electrical parameter can be a parameter selected that remains relatively constant as long as the dispenser is dispensing a liquid. When the liquid is relatively low in the reservoir or empty, the monitored electrical parameter can change and either increase or decrease. In accordance with the present disclosure, the increase or decrease is monitored and used to determine when the liquid reservoir no longer contains the liquid. The dispenser system of the present disclosure can then send a signal indicating a low level of liquid condition. Maintenance personnel, for instance, can be alerted and can refill the reservoir or attach a new reservoir without the dispenser remaining in a low condition for an extended period of time and without replacing a liquid reservoir prematurely and wasting product.

Figure 2:
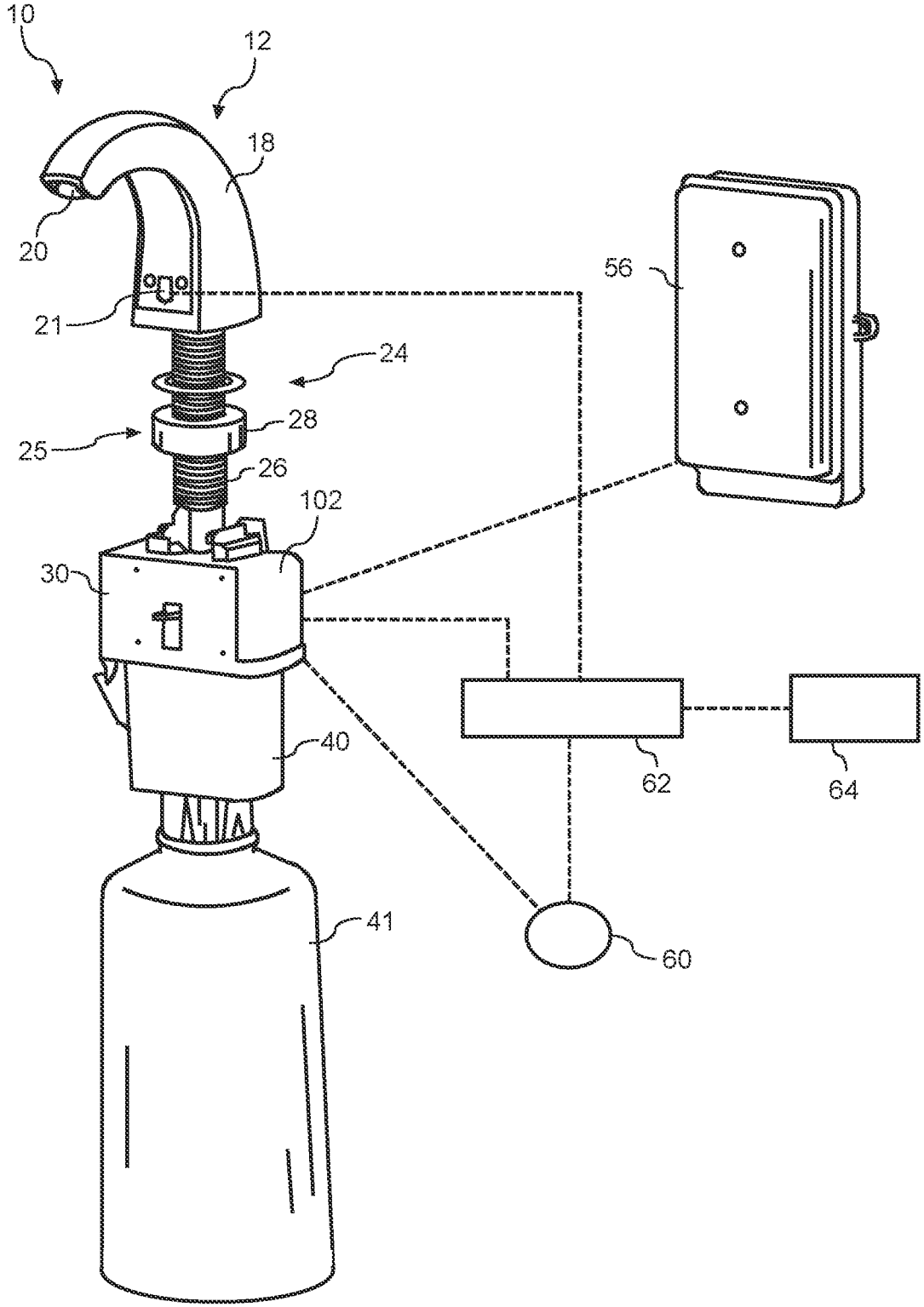
FIG. 2 illustrates another embodiment of the counter-mounted viscous liquid dispenser illustrated in FIG. 1.

Referring to FIGS. 1 and 2, one embodiment of a dispenser system 10 in accordance with the present disclosure is shown. For exemplary purposes only, the dispenser system 10 is an in-counter mounted dispenser. The dispenser of the present disclosure, however, is not so limited and can be wall mounted, freestanding, etc. As shown particularly in FIG. 1, the dispenser system 10 is mounted in a counter 11 in a typical washroom facility.

As shown, the dispenser system 10 includes a dispenser fixture 12 having an above-counter portion 14 located adjacent to a sink bowl 16. As shown, above-counter portion 14 includes a dispensing head 18 having a delivery spout or nozzle 20 extending from the dispensing head 18. Delivery spout 20 is positioned and configured in a conventional manner to supply soap, liquids, or foams to the hand of a user. As shown, the delivery spout 20 is positioned over the sink bowl 16, so that in an event that the liquid product is unintentionally dispensed from the dispensing apparatus, the liquid product will make its way into the sink bowl 16, rather than the counter 11.

The dispenser system 10 as shown in FIGS. 1 and 2 can include an actuator that, once actuated, causes the dispenser system 10 to dispense a metered dose of a liquid or foam. In one embodiment, the actuator can comprise an actuation button 22. To dispense the liquid product from the dispenser system, a user presses the actuation button 22, which in turn activates a pumping device 30 and a quantity (i.e., dose) of the liquid product is delivered to the user's hand. Alternatively, the dispenser system 10 may have an electronic actuator 21, positioned such that the electronic actuator 21 can detect the hands of a user under the delivery spout 20. When the electronic actuator 21 detects the user hand under the delivery spout 20, an electronic means is activated and a quantity of liquid product is delivered to the user's hand. Generally, the actuator button 22 and/or the electronic actuator 21 are electrically connected to a control panel (not shown) having control circuitry which is used to detect a user's hand near under the spout 20, or the user's input to the actuator button 22. In addition, the control circuitry is used to activate the pumping device 30 for a given period of time so that the user receives a dose, such as a specific predetermined amount, of the liquid product. Control circuitry for actuators and actuator buttons is known to those skilled in the art and is shown, for example in U.S. Pat. No. 6,929,150 to Muderlak et al., which is hereby incorporated by reference.

The dispenser fixture 12 includes an under-counter portion 24 having a mounting system 25 securing the dispenser fixture 12 to the counter. The mounting system 25 has an elongated tube 26, which is a generally elongated hollow tube, extending through a hole defined in counter 11. By "hollow", it is intended that a tube has a passage or channel (not shown in FIG. 1) that extends through the elongated tube 26 from proximate end 26P of the elongated tube 26, which is located above the counter 11, to the distal end 26D of the elongated tube 26 located below the counter 11. The elongated tube 26 has a flange 23 on the end of the elongated tube that is positioned above the counter 11. The flange 23 is of a size which is larger than the hole in the counter 11 and the flange 23 serves to keep the elongated tube 26 from falling through the counter 11. As is shown in FIG. 1, the mounting system 25 also has an anchoring mechanism 28 associated with the portion of the elongated tube 26 which extends below the counter 11. The mounting system shown in FIG. 1 or 2 is one type of mounting system which may be used in the present invention. It is noted that other types of mounting systems may also be used. The mounting system 25 as shown in FIG. 1 has an elongated tube 26 which is threaded and the anchoring mechanism 28 is a nut threaded onto the threads of the elongated tube 26. Other mounting systems may be used in place of the mounting system 25 shown in FIG. 1.

The under-counter portion 24 includes the pumping device 30 connected on one end to the elongated tube 25 and on an opposite end to a connecting member 40. The connecting member 40 is in turn connected to a liquid reservoir 41. The liquid reservoir 41 is for containing a liquid product, such as a soap composition. The liquid reservoir 41, the connecting member 40, and the pumping device 30 can all be removably connected to the dispenser assembly 10. One or more delivery tubes can be inserted from the pumping device 30, through the connecting member 40 and into the liquid reservoir 41 for providing fluid communication between the delivery head 18 and the spout or nozzle 20 and the liquid reservoir 41. Such configurations are known in the art and can include those described in U.S. Pat. No. 8,100,299 B2 to Phelps et al., which is hereby incorporated by reference.

As shown in FIG. 2, the dispensing system 10 and particularly the pumping device 30 can be in communication with a power supply 56. The power supply 56 can be separate from the rest of the dispenser assembly 10 or can be integral with the dispenser assembly. For instance, in one embodiment, the power supply 56 can be integral with the pumping device 30 or connecting member 40. Separating the power supply 56 from the pumping device 30, however, allows for the power supply 56 to be replaced when needed. In this regard, the power supply 56 can be disconnected and reconnected to the pumping device 30 as desired. To ensure that power is transferred from the power supply 56 to the pumping device 30, electrical contact points may be used on both the pumping device 30 and on the power supply 56, such that the electrical contact points are in complementary positions, meaning that when the power supply 56 is attached to the pumping device 30, an electrical connection is made.

The power supply 56 can be configured to provide an alternating current or a direct current. The power supply 56, for instance, can be connected to the electrical system of the facility in which the dispensing assembly 10 resides. Alternatively, the power supply 56 can comprise one or more batteries. The one or more batteries can be disposable or can be rechargeable.

In accordance with the present disclosure, as described above, the dispensing assembly 10 includes a pumping device 30 that not only can accurately dispense metered doses of a liquid from the liquid reservoir 41, but also can provide various control benefits in operating the dispenser assembly 10. The pumping device 30, for instance, can include a motor, particularly a brushless motor, that is periodically activated for dispensing controlled amounts of a liquid from the liquid reservoir 41 and out through the nozzle or spout 20. Incorporating a brushless motor into the pumping device 30 can provide numerous benefits and advantages. For instance, the use of a brushless motor can make the pumping device 30 not only more accurate but also more controllable. For example, various electrical parameters can be monitored during periodic use of the pumping device 30. These electrical parameters can then be monitored and used to not only dispense controlled amounts of a liquid, but for various other useful purposes. For example, in one embodiment, monitoring electrical parameters of the pumping device 30 during operation can indicate when the liquid reservoir 41 is in an empty state or contains a low level of liquid.

The brushless motor contained in the pumping device 30 can include a rotor comprised of permanent magnets that surrounds a stator. The stator can include an even number of coils that form electromagnets. The stator is stationary and the rotor rotates. Rotation of the rotor is achieved by controlling the magnetic fields generated by the coils. Rotational speed, for instance, can be controlled by changing the voltage for the coils. Brushless motors allow for accurate control of rotation by adjusting the magnitude and direction of the current into the coils. Consequently, the motor is electronically commutated. Motors incorporated into the pumping device 30 of the present disclosure are not only very efficient but very controllable. The motor, for instance, can be controlled using feedback mechanisms in order to precisely deliver the desired torque and rotational speed of the motor. The efficiency of the motor in combination with the precision control reduces energy consumption allowing the power supply 56 to last longer. In addition, metered doses of liquid can be dispensed from the liquid reservoir 41 in a uniform and precisely controlled manner that directly relates to the operation of the brushless motor. In one embodiment, the electric motor contained in the pumping device 30 uses a direct current electric power supply.

In one particular embodiment, the motor contained in the pumping device 30 can be a three-phase motor. In one aspect, the motor can have a gear box ratio of from about 1:10 to about 1:40, such as from about 1:23 to about 1:28. The rpm of the motor can be from about 2,000 to about 10,000, such as from about 3,000 to about 7,000, such as from about 4,100 to about 5,200.

As shown in FIGS. 1 and 2, the dispensing system 10 can include a sensor 60 in communication with the pumping device 30. The sensor 60, for instance, can sense or monitor at least one electrical parameter of the motor contained in the pumping device 30 when the pumping device 30 is periodically activated. Various different electrical parameters can be sensed and monitored. Electrical parameters that can be monitored include, for instance, current draw, torque, rotational velocity of the rotor or the impeller, voltage, frequency variations, pulse with modulations, or any other suitable parameter. As shown in FIGS. 1 and 2, the sensor 60 can be in communication with a processor 62. The processor 62 can receive information from the sensor 60 regarding the at least one electrical parameter. Based on the information received from the sensor 60, the processor 62 can then be configured to make adjustments within the dispenser system 10. The processor, for instance, can be used to adjust the motor contained within the pumping device 30 in order to adjust the amount of liquid being dispensed from the liquid dispenser 41.

In one embodiment, the processor 62 can receive information regarding the at least one electrical parameter and, based on the information received, determine whether the liquid reservoir 41 is in a low liquid state.

For example, as shown in FIGS. 1 and 2, in one embodiment, the sensor 60 senses at least one electrical parameter which is communicated to the processor 62. If the electrical parameter varies by greater than a preset amount between metered doses of a liquid, the processor can then be configured to create a signal indicating that the liquid reservoir contains a low level of liquid. Various different types of signals can be created or produced by the processor 62. In one embodiment, for instance, the signal created by the processor 62 can cause a light to illuminate indicating that the liquid reservoir 41 needs to be refilled. The light can be, in one embodiment, located on the dispensing head 18. Alternatively, the light can be on a control panel accessible by maintenance personnel.

In an alternative embodiment, the signal created by the processor 62 can be communicated to a control center for alerting maintenance personnel regarding the low liquid level condition of the liquid reservoir 41. As shown in FIGS. 1 and 2, for instance, the processor 62 can be in communication with a control center 64. The control center 64, for instance, can be any suitable monitoring device or computer system. The signal can be communicated to the control center 64 wirelessly or through electrical communication channels. In one particular embodiment, the signal generated by the processor 62 can be fed to the control center 64 which then shows up as an alert on a mobile device carried by maintenance personnel. In this manner, the liquid reservoir 41 can be refilled or replaced very soon after the signal is generated.

Figure 4:
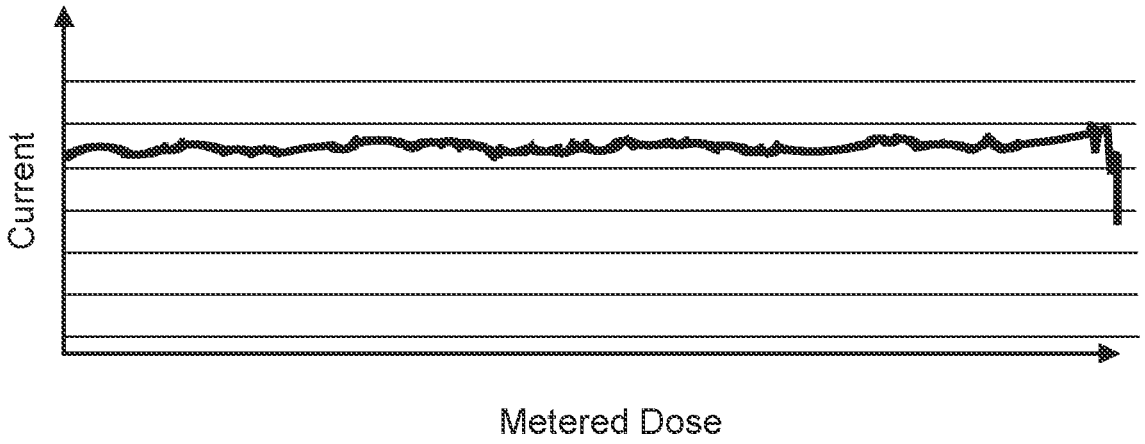
FIG. 4 is a representative graph illustrating current over time of a pumping device as may be operated in accordance with the present disclosure.

The amount the electrical parameter varies before the processor 62 creates a signal indicating that the liquid reservoir contains a low level of liquid can vary depending upon numerous factors including the type of electrical parameter monitored. In one aspect, the electrical parameter being monitored is current draw. When using a brushless motor in accordance with the present disclosure, it was discovered that monitoring current draw during periodic operation of the pumping device 30 can accurately determine when the liquid reservoir contains a low level of liquid. Referring to FIG. 4, for exemplary purposes, a graph is illustrated showing current versus the number of metered doses or shots. As shown, the current remains relatively uniform and stable as long as liquid is contained within the liquid reservoir 31. Once liquid levels are low or in an empty state, however, the current can decrease in an abrupt manner that can be easily recognized by the processor 62. In one embodiment, for instance, the current can be monitored by the sensor 60 and a signal can be generated by the processor 62 when the current varies by more than about 2%, such as by more than about 2.5%, such as by more than about 3%, such as by more than about 3.5%, such as by more than about 4% as the pumping device is periodically operated. Alternatively, instead of percent difference, the processor can also monitor a quantity difference and create a signal when the quantity difference in measurements is greater than a preset amount.

The sensor 60 and the processor 62 can be combined into a single device or can be separate devices within the dispenser assembly system 10. In FIGS. 1 and 2, the sensor 60 and the processor 62 are shown separate from the motor 30. In one embodiment, however, the sensor 60 and the processor 62 can be integral with the motor 30 and contained within the same motor housing. The processor 62 can comprise any suitable electronic device capable of comparing data and storing information. The processor 62, for instance, can comprise one or more microprocessors which can be part of a computer system. In one embodiment, the processor 62 can be part of the control center 64 and can receive data from the sensor 60 through a web-based or a cloud-based communication system.

The sensor 60 can be any suitable device capable of sensing at least one electrical parameter of the pumping device 30. In one embodiment, for instance, the sensor 60 can be a sensor capable of sensing and monitoring current draw, voltage, or the like.

In one aspect, the processor 62 can be configured to do more tasks than create a signal indicating that the liquid reservoir contains a low level of liquid. For instance, as shown in FIG. 1, the processor 62 can be in communication with the actuator 21 and can be in communication with the pumping device 30. The processor 62, for instance, can receive information from the actuator indicating that a user's hand has been detected. The processor 62 can then receive this information and activate the pumping device 30 for dispensing a metered dose of liquid from the liquid reservoir 41. In addition, the processor 62 can receive various information from the sensor 60 regarding one or more electrical parameters received from the pumping device 30. Based on the information received, the processor 62 can also be configured to control the pumping device in order to control and adjust the amount of liquid that is dispensed during each activation of the dispensing system 10. The processor 62, for instance, can be designed to control the amount of time that the pumping device stays on, can control the motor rpm of the pumping device, or can control some other characteristic of the pumping device in order to control the metered dose that is dispensed.

Figure 3:
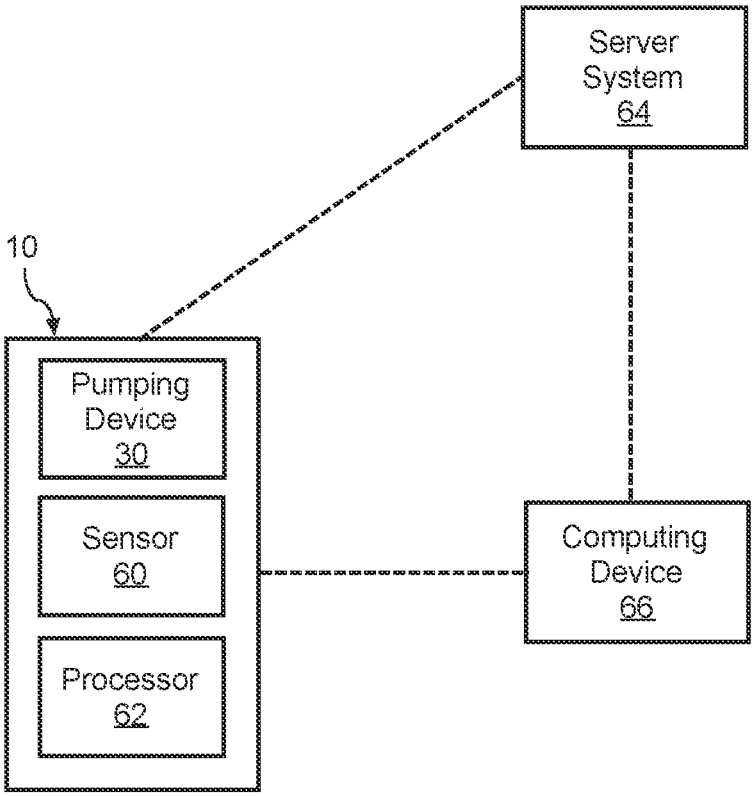
FIG. 3 illustrates a block diagram of an example network enabled dispenser system according to example embodiments of the present disclosure.

Referring to FIG. 3, one embodiment of a block diagram illustrating the system of the present disclosure is shown. As described above, the dispenser system 10 can include some type of actuator that actuates the pumping device 30 for dispensing controlled amounts of a liquid or foam through the nozzle 20. The liquid reservoir 41 can contain a plurality of doses of the liquid. For instance, the liquid reservoir 41 can contain greater than about 200 doses, such as greater than about 500 doses, such as greater than about 700 doses, such as greater than about 1,000 doses, and generally less than about 5,000 doses of the liquid. The pumping device 30 is periodically activated in order to dispense the liquid in a controlled manner based upon information received from an actuator. As shown in FIG. 3, the sensor 60 is designed to monitor at least one electrical parameter of the pumping device 30 during operation of the pumping device 30 and the dispensing of doses. Information from the sensor 60 can be fed to the processor 62. The processor 62 can be designed to generate an average of the electrical parameter based on information received from the sensor 60 during the dispensing of previous doses. The average of the electrical parameter based on previous doses can be based upon a set number of previous metered doses in order to establish a reliable baseline. For instance, the processor 62 can be designed to calculate and create an average based on information received from the previous 10 metered doses, 40 metered doses, 60 metered doses, 80 metered doses, or the like. Once a certain number of metered doses has occurred, the determined average of the electrical parameter can then be compared to the electrical parameter of future metered doses to determine whether the electrical parameter has varied beyond the preset amount.

In one embodiment, the sensor 60 can be designed to monitor multiple times the electrical parameter during a single metered dose or periodic operation of the pumping device. Consequently, the processor 62 can also be configured to calculate an average of the electrical parameter during each single metered dose. This average can then be compared to an average of the electrical parameter over multiple previous metered doses. In still another embodiment, the sensor 60 can continuously monitor the electrical parameter during operation of the pumping device and the processor 62 can create an average from the continuous monitoring or, alternatively, use a high value or low value during continuous monitoring to compare with the average electrical parameter generated from previous metered doses.

As shown in FIG. 3, the dispensing assembly 10 further includes a server system 64 and a computing device 66. The processor 62 can be configured to communicate with the server 64. For instance, the processor 62 can be configured to generate a signal that is sent to the server system 64 when the liquid reservoir contains a low level of liquid. In one embodiment, the server system 64 can generate an alert and send it to one or more computing devices 66. The computing device 66 can include any number of peripheral mobile devices, including smartphones and tablets. In this manner, maintenance personal can be notified immediately when a low level of liquid in the liquid reservoir 41 is detected.

The processor 62 can also be part of a controller that comprises one or more programmable devices and/or control circuitry. The controller can control and monitor all functions of the dispensing system 10 including dose amount of product being dispensed, product usage, and any other activities that are occurring within the dispensing system 10. The controller can be configured to communicate information regarding the dispensing system 10 to the server system 64 via wired means or through a wireless web-based system. Communication from the processor 62 and/or any other controllers can be accomplished through wired-connections or wireless connections, (e.g., Bluetooth Low Energy protocol). Wireless communications between components of the dispenser system 10 can also be established via other wireless protocol, such as by cellular communications.

Figure 5:
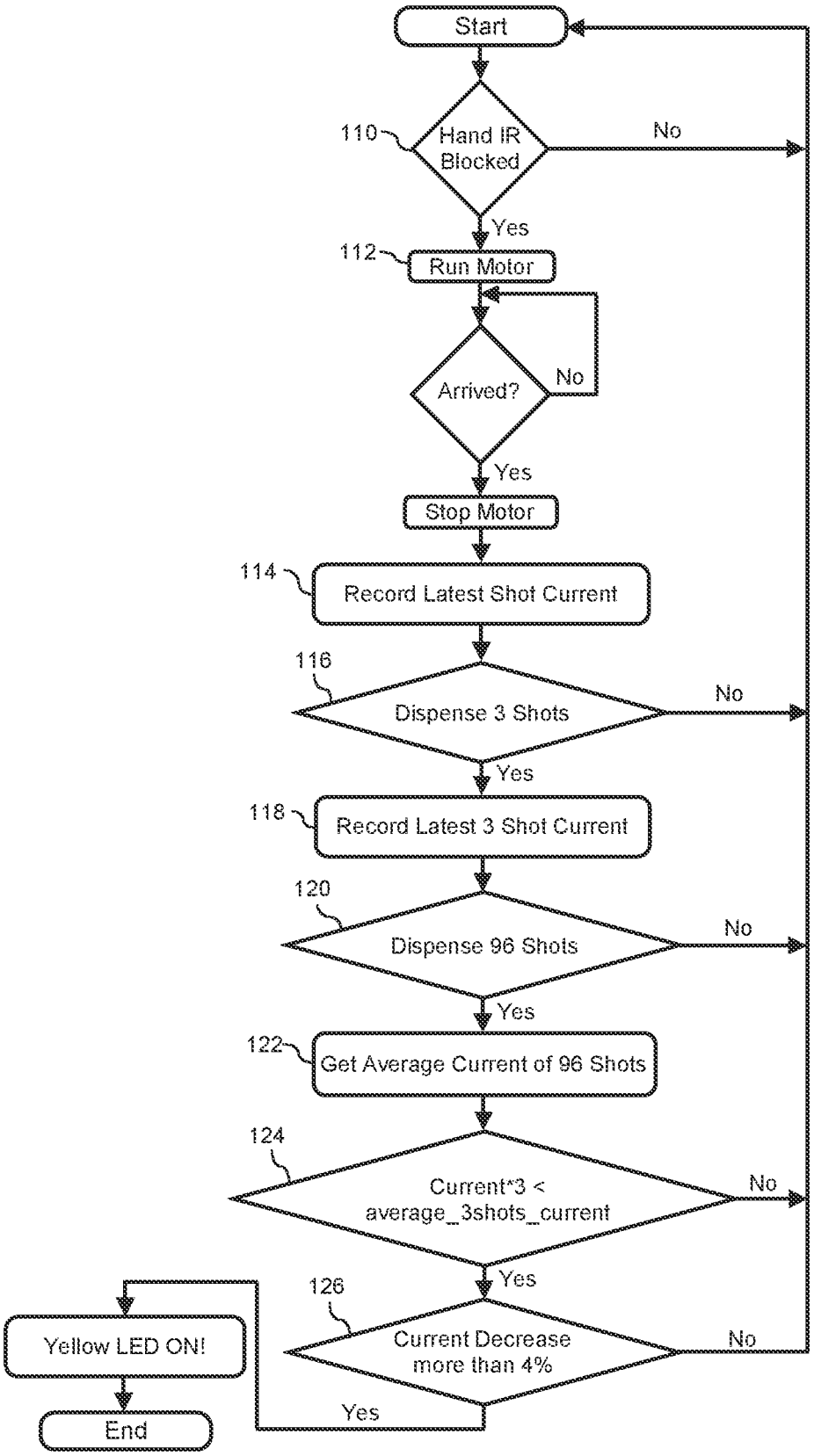
FIG. 5 is a block diagram of one embodiment of a process in accordance with the present disclosure.

For exemplary purposes only, FIG. 5 illustrates one embodiment of a process in accordance with the present disclosure for dispensing metered doses of a liquid and for determining when there is a low level condition in the liquid reservoir. As shown, the process begins when an actuator 110 detects the presence of a hand. The actuator 110, for instance, can be an IR sensor that emits an IR beam. When an object is detected within the beam, the actuator actuates and causes the pumping device to run for a periodic amount of time as shown at 112. During operation of the motor within the pumping device, at least one electrical parameter can be monitored. For instance, as shown in FIG. 5, current is monitored at 114 during operation of the motor.

In the process illustrated in FIG. 5, the process monitors the current for three metered doses as shown at 116. As shown at 118, the current over three metered doses is averaged to provide a value. The current value over the previous three metered doses is then compared to an average value over a greater number of metered doses. For instance, as shown at 120, in this embodiment, an average is generated over the previous 96 metered doses as shown at 120 and 122. At 124, a comparison is then made between the average of the previous three metered doses and the average of the previous 96 metered doses. As shown at 126, if the current value based on the past three metered doses decreases by more than 4% in comparison to the current value of the previous 96 metered doses than a signal is generated indicating that the liquid reservoir contains a low level of liquid.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed:

1. A dispenser for dispensing a metered dose of foam or liquid from a reservoir comprising:

a nozzle;

a liquid reservoir in fluid communication with the nozzle;

a pumping device for pumping metered doses of a liquid from the liquid reservoir and out through the nozzle;

a sensor for sensing at least one electrical parameter of the pumping device during pumping of metered doses, wherein the at least one electrical parameter comprises electric current; and a processor in communication with the sensor for receiving information regarding the at least one electrical parameter, wherein, if a first average of the at least one electrical parameter varies by greater than 3% from a second average of the at least one electrical parameter, the processor is configured to create a signal indicating that the liquid reservoir contains a low level of liquid, wherein the first average of the at least one electrical parameter comprises an average of the at least one electrical parameter over a first number of metered doses and the second average of the at least one electrical parameter comprises an average of the at least one electrical parameter over a second number of metered doses, wherein the second number of metered doses comprises a number of doses greater than the first number of metered doses.

2. A dispenser as defined in claim 1, wherein the pumping device comprises a motor.

3. A dispenser as defined in claim 2, wherein the motor comprises a brushless motor.

4. A dispenser as defined in claim 1, wherein the first average of the at least one electrical parameter over a first number of metered doses comprises an average of the at least one electrical parameter over a previous one to five metered doses.

5. A dispenser as defined in claim 4, wherein the second average of the least one electrical parameter comprises an average of the least one electrical parameter over a previous eighty to one hundred metered doses.

6. A dispenser as defined in claim 1, wherein the signal created by the processor causes a light to illuminate on the dispenser.

7. A dispenser as defined in claim 1, wherein the signal created by the processor is transmitted to a cloud-based operation control center.

8. A dispenser as defined in claim 1, wherein the dispenser comprises a fixture assembly configured to be mounted to a counter, the fixture assembly comprises a dispensing head, the nozzle being contained in the dispensing head.

9. A dispenser as defined in claim 1, wherein the processor comprises one or more microprocessors.

10. A dispenser as defined in claim 1, further comprising an actuator that, once actuated, causes the pumping device to pump a metered dose of liquid from the liquid reservoir out through the nozzle.

11. A dispenser as defined in claim 10, wherein the actuator comprises a hand sensor.

12. A dispenser as defined in claim 1, wherein if a first average of the at least one electrical parameter varies by greater than 4% from a second average of the at least one electrical parameter the processor is configured to create a signal indicating that the liquid reservoir contains a low level of liquid.

13. A dispenser for dispensing a metered dose of foam or liquid from a reservoir comprising:

a nozzle;

a liquid reservoir in fluid communication with the nozzle;

a pumping device for pumping metered doses of a liquid from the liquid reservoir and out through the nozzle, the pumping device comprising a brushless motor;

an actuator that, once actuated, causes the pumping device to pump a metered dose of liquid from the liquid reservoir and out through the nozzle; and a sensor for sensing at least one electrical parameter of the brushless motor, wherein the at least one electrical parameter comprises electric current, the dispenser further comprising a processor in communication with the sensor for receiving information regarding the at least one electrical parameter, and wherein, if a first average of the at least one electrical parameter varies by greater than 3% from a second average of the at least one electrical parameter, the processor is configured to create a signal indicating that the liquid reservoir contains a low level of liquid, wherein the first average of the at least one electrical parameter comprises an average of the at least one electrical parameter over a first number of metered doses and the second average of the at least one electrical parameter comprises an average of the at least one electrical parameter over a second number of metered doses, wherein the second number of metered doses comprises a number of doses greater than the first number of metered doses.

14. A dispenser as defined in claim 13, wherein the brushless motor comprises an electronically commutated motor, and wherein the dispenser further comprises a sensor that senses at least one electrical parameter of the brushless motor, the at least one electrical parameter comprising voltage, current, torque, rotational velocity, or mixtures thereof, and wherein the dispenser further comprises a processor configured to receive information from the sensor for adjusting the brushless motor in dispensing the metered doses.

15. A method for dispensing a liquid or foam from a dispenser comprising:

periodically operating a pumping device for pumping metered doses of a liquid from a liquid reservoir and out through a dispenser nozzle, the pumping device being operated for a period of time sufficient to produce the metered dose;

monitoring at least one electrical parameter of the pumping device during pumping of the metered doses, wherein the at least one electrical parameter comprises electric current; and generating a signal that indicates that the liquid reservoir contains a low level of liquid when a first average of the at least one electrical parameter varies by greater than 3% from a second average of the at least one electrical parameter, wherein the first average of the at least one electrical parameter comprises an average of the at least one electrical parameter over a first number of metered doses and the second average of the at least one electrical parameter comprises an average of the at least one electrical parameter over a second number of metered doses, wherein the second number of metered doses comprises a number of doses greater than the first number of metered doses.

* * * * *